United States Patent [19]

Connell et al.

[11] Patent Number: 4,933,849

[45] Date of Patent: Jun. 12, 1990

[54] SECURITY SYSTEM FOR USE WITH AN INDICIA PRINTING AUTHORIZATION DEVICE

[75] Inventors: Richard A. Connell, South Salem, N.Y.; Ronald P. Sansone, Weston, Conn.

[73] Assignee: Pitney Bowes, Stamford, Conn.

[21] Appl. No.: 74,424

[22] Filed: Jul. 16, 1987

[51] Int. Cl.[5] ..... G07B 17/02

[52] U.S. Cl. ..... 364/400; 364/464.02

[58] Field of Search ..... 364/400, 464.02; 235/457, 495

[56] References Cited

U.S. PATENT DOCUMENTS

| | | | |
|---|---|---|---|
| 4,024,380 | 5/1977 | Gunn | 235/375 |
| 4,097,923 | 6/1978 | Eckert | 364/900 |
| 4,326,460 | 4/1982 | Nukell | 101/110 |
| 4,447,890 | 5/1984 | Duwel | 364/900 |
| 4,464,566 | 8/1984 | Silverman | 235/457 |
| 4,491,725 | 1/1985 | Pritchard | 235/375 |
| 4,625,100 | 11/1986 | Smith | 235/458 |
| 4,644,266 | 3/1987 | Eckert | 235/494 |
| 4,687,526 | 8/1987 | Wilfert | 264/134 |
| 4,725,718 | 2/1988 | Sansone | 235/495 |
| 4,750,137 | 6/1988 | Harper | 364/514 |
| 4,802,212 | 1/1989 | Wright | 235/492 |

FOREIGN PATENT DOCUMENTS

| | | |
|---|---|---|
| 2073661 | 3/1981 | United Kingdom . |
| 2188878 | 10/1987 | United Kingdom . |

*Primary Examiner*—Jerry Smith
*Assistant Examiner*—Gail O. Hayes
*Attorney, Agent, or Firm*—Donald P. Walker; Melvin J. Scolnick; David E. Pitchenik

[57] ABSTRACT

A security system for use with an indicia printing authorization device includes a computer having a nonvolatile memory associated therewith. Graphic change information can be downloaded to the device by an external authority. The graphic change information includes the data when the different pattern is authorized. On that date, all indicia printers that do not print the authorized pattern will be suspect.

23 Claims, 5 Drawing Sheets

SECURITY SYSTEM FOR USE WITH AN INDICIA PRINTING AUTHORIZATION DEVICE

BACKGROUND OF THE INVENTION

The present invention generally relates to a security system for use with an indicia printing authorization device and, in particular, relates to such a security system having a plurality of indicia patterns selectively available for printing.

There exist numerous instances wherein the application of a mark to a document represents monetary value. For instance, the application of an indicia to a piece of mail represents that the cost of the postage therefor has been paid. As the use of electronically controlled printers increases, these indicia may be more frequently applied by such printers. One of the more versatile types of printers is the dot matrix type of printer that, in fact, applies a plurality of relatively small dots to form a particular letter, numeral or pattern. The particular pattern so formed is generally electronically controllable.

In the particular instance of applying a postage indicia, postage meters that are electronically operated already exist. In addition, other types of mailing systems such as those used for manifest and permit mail that include electronics, particularly for controlling the printing of indicia, are also currently available.

In general, the United States Postal Service requires the inspection of postal meters twice a year. This inspection currently necessitates an on-site visit to the postage meter location by a representative of the postage meter manufacturer. Such visits represent a considerable expense for the manufacturer and, in fact, do not prevent a user from printing fraudulent postage indicia. The primary purpose of such visits is to inspect the postage meter to ascertain if the particular meter has been subjected to tampering. These inspections do not, however, prevent such fraudulent practices as the unauthorized printing of a postal indicia by another printer or the generation of a postal indicia by other means. Hence, although current security measures are quite effective, the implementation of new technologies to postal systems and services provides the opportunity for increasing the security thereof at relatively inexpensive investments.

Consequently, a security system that can detect such fraudulent practices, as well as supplement required on-site inspections is clearly desired in industries that utilize indicia to represent monetary value.

SUMMARY OF THE INVENTION

Accordingly, it is one object of this invention to provide a security system for use with an indicia printing authorization device.

This object is accomplished, at least in part, by a security system having means, remote from an indicia printing authorization device, for causing a particular one of a plurality of indicia patterns to be printed such that the indicia pattern printed is representative of the authenticity of the indicia printing means.

Other objects and advantages of the present system will become apparent to those skilled in the art from the following detailed description read in conjunction with the appended claims and the drawings attached hereto.

DETAILED DESCRIPTION OF THE INVENTION

Figure 1:
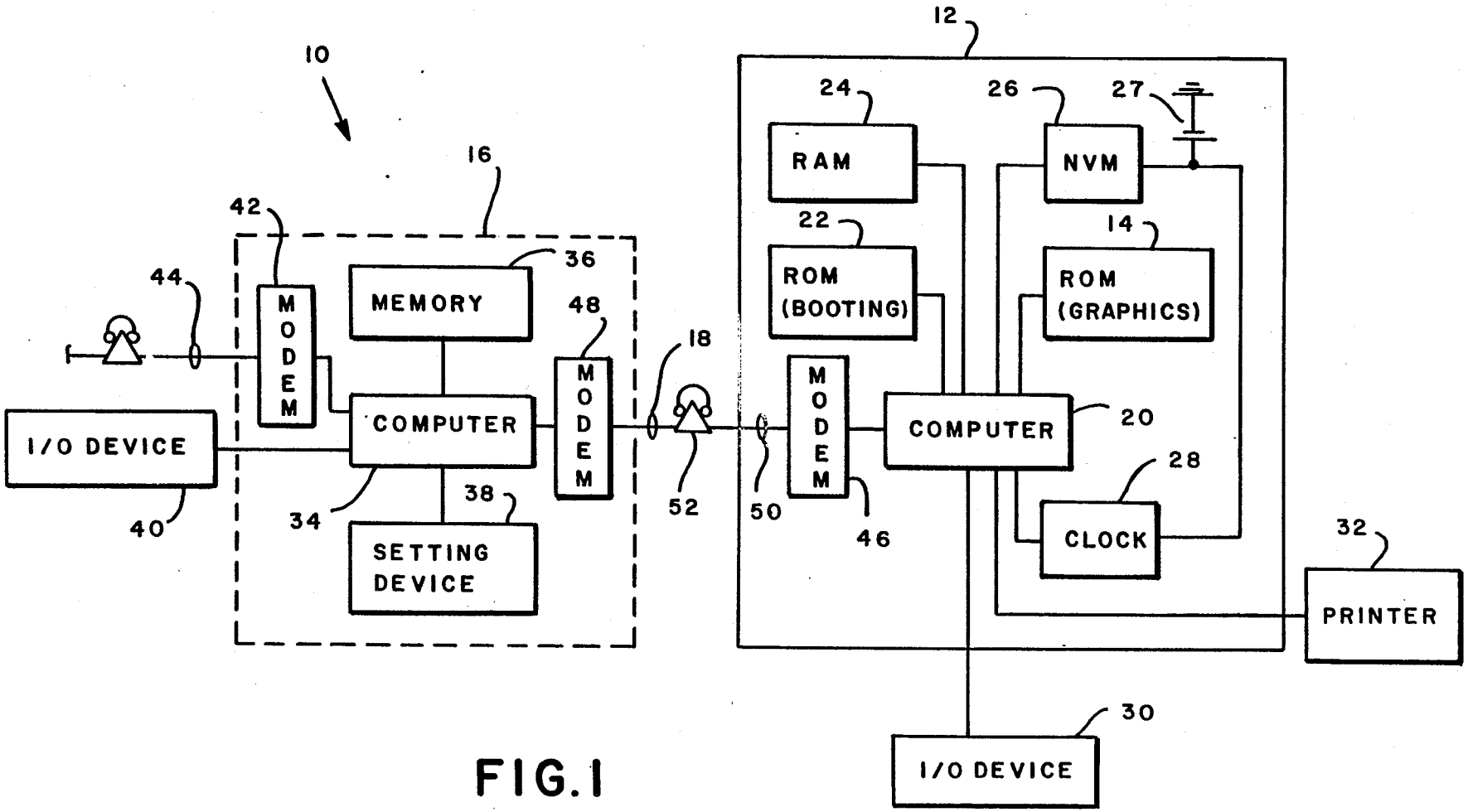
FIG. 1 is a block diagram of a security system embodying the principles of the present invention.

A security system, generally indicated at 10 in FIG. 1 and embodying the principles of the present invention, includes means 12 for authorizing the printing of an indicia, the means 12 including means 14 for storing a plurality of indicia patterns, means 16, remote from the indicia printing authorization means 12, for controlling the selection of the indicia pattern that is authorized to be printed and means 18 for establishing communication between the printing authorization means 12 and the authorized indicia selection controlling means 16.

In one embodiment, the printing authorization means 12 includes a computer 20. Preferably, the computer includes a Read-Only-Memory (ROM) 22, a Random-Access-Memory (RAM) 24, a nonvolatile memory (NVM) 26 and a clock/calendar 28. In this particular embodiment, the printing authorization means 12 communicates, for example, via the computer 20, with an input/output device 30 and a printer 32 capable of printing the selected indicia.

In this embodiment, the means 16 for controlling the selection of the indicia pattern that is authorized to be printed also includes a computer 34. Preferably, the means 16 also includes a memory 36 and a setting device 38, both the memory 36 and the device 38 being in communication with the computer 34. Further, in this embodiment, the computer 34 communicates with an input/output device 40. In addition, in one particular embodiment, the computer 34 also communicates, via, for example, a modem 42, with a communication medium 44.

In one particular embodiment, the means 14 for storing a plurality of indicia patterns is a semiconductor memory. This memory can be a Programmable Read Only Memory (PROM), a ROM, a nonvolatile RAM, or the like. Regardless of the specific device used for the implementation thereof, the means 14, in this embodiment, includes a plurality of different indicia patterns, each being individually accessible by the computer 20. Preferably, each of the indicia patterns are accessed via an address stored in the nonvolatile memory 26. The indicia patterns, i.e. the instruction sets that, when conveyed to the printer 32, result in a particular indicia being printed thereby, can be stored in the means 14 in any convenient format desired such as, for example, ASCII character strings or as bit mapped images. One advantage of storing the indicia patterns as ASCII character strings, compared to a bit mapped image, is that less memory space is required for storing each particular pattern.

The means 18 for establishing communication between the printer authorization means 12 and the authorized indicia selection controlling means 16, in one embodiment, includes a first modem 46 connected to the computer 20 and a second modem 48 connected to the computer 34. The first and second modems, 46 and 48, respectively, communicate via a communication medium 50 that may include one or more telephone subsets 52.

In one particular embodiment, the computer 20 of the means 12 for authorizing the printing of an indicia may be a microprocessor device. Such devices are readily available from commercial semiconductor outlets. Typically the microprocessor device can be, for example, an Intel 8085 device available from Intel Corp., Santa Clara, Calif. Other devices of this general type and function are also available and may also be utilized.

The ROM 22, in this embodiment, contains the necessary command and instruction sets to initialize the microprocessor device and, typically, is connected to the local bus of the microprocessor device. Hence, when the computer 20 is turned on, or reinitialized, the ROM 22 provides the necessary commands to the computer to begin the operation of the means 12. In addition, the ROM 22 can also include specific utility programs that would be useful and convenient in the operation of the means 12.

The RAM 24 provides storage space for real time data used by the computer 20 during the operation thereof. Usually, the RAM 24 is also connected to the local bus of the microprocessor device. The ROM 22 and RAM 24 can either be separate semiconductor chips manufactured by the manufacturer of the microprocessor device or the microprocessor device, the ROM 22 and the RAM 24 may be integrated into a single device. Such RAMs and ROMs are well known and they need not be manufactured by the identical manufacturer of the device in order to be compatible therewith.

The nonvolatile memory 26, usually a random access memory, is provided for storing information that, although changeable, is nevertheless required to be retained even if the power to the computer is turned off or otherwise interrupted. Such a RAM usually includes a back-up power supply, such as, for example, a battery 27. In one particular application of the system 10, the information so retained includes, inter alia, a specific memory address whereat the computer 20 can find the particular address in the means 14 of the particular indicia that has been authorized to be printed. In general, the nonvolatile memory 26, as well as the means 14, are fabricated using conventional complementary-metal-oxide-semiconductor (CMOS) techniques and, hence, require relatively low current to maintain the gate conditions thereof.

The clock/calendar 28 is used to maintain a calendar such that the date and time can be mechanically or electronically set during installation, or start up, and thereafter maintained. Preferably, the clock/calendar 28 is connected to, in this embodiment, the battery 27 so that even if the means 12 is without power the correct date and time is maintained. Clock/calendar chips as known, are readily available from the commercial market. Such an application of the clock/calendar 28 supports, as more fully discussed hereinafter, the implementation of a change of authorized indicia on a preselected date.

The input/output device 30 can be any element, or device, that is adaptable to provide information to, or receive information from the computer 20. Typically, the input/output device 30 will include a keyboard and a visual display. Naturally, other devices can also be used as an alternative to, or in conjunction with the keyboard and display. In fact, in one implementation, it is preferable that the computer 20 be capable of reading from and/or writing to any conventional information handling device including, but clearly not limited to, disks, diskettes, magnetic tapes, smart cards or the like.

The printer 32 can be any device capable of producing, under the general control of the computer 20, an image, or graphic, pattern. Such devices can include dot matrix printers, ink jet printers, or the like. These types of printers are readily available in the commercial market. Preferably, the means 12 includes a variety of command and control instruction sets such that the more popular off-the-shelf printers can be readily controlled and operated with the system 10.

In this embodiment, the computer 34 of the authorized indicia selection control means 16 is a substantially larger device than the computer 20 and could even be a mainframe computer. Likewise, the memory 36 connected to the computer 34 is, in this embodiment, substantially larger than the memory of the means 12. One significant advantage of such a size difference is that a single means 16 can then be used to control the selection of authorized indicia for a plurality of means 12. Based on this capability, the system 10 can be implemented to encompass a vast geographic area with a single controlling means 16.

The means 16 also includes the setting device 38. In this embodiment the setting device 38, under the control of the computer 34, effectively downloads to the computer 20, information relating to the selected authorized indicia pattern to be used by the computer 20 during the indicia printing by the printer 32. As more fully discussed below, the information so downloaded will include an address and a date and, in order to enhance the security of the system 10, is directed into the nonvolatile memory 26 such that it is inaccessible to the user of the means 12. Although many setting devices 38 can be readily developed, schemes such those described in U.S. Pat. Nos. 3,792,446; 4,097,923; and 4,447,890 are preferred when the system 10 is implemented to print postal indicia. These patents generally relate to the remote recharging of registers located in postal devices. The inclusion in a recharging information bit stream of the selected authorized indicia address and date is considered straightforward and need not be described herein in further detail.

The input/output device 40 and the communication medium 44, in conjunction with the modem 42, allow information to be exchanged with the computer 34. Hence, the selection of a particular authorized indicia pattern and the effective date for the use thereof can be externally inputted to the computer 34.

Figure 2:
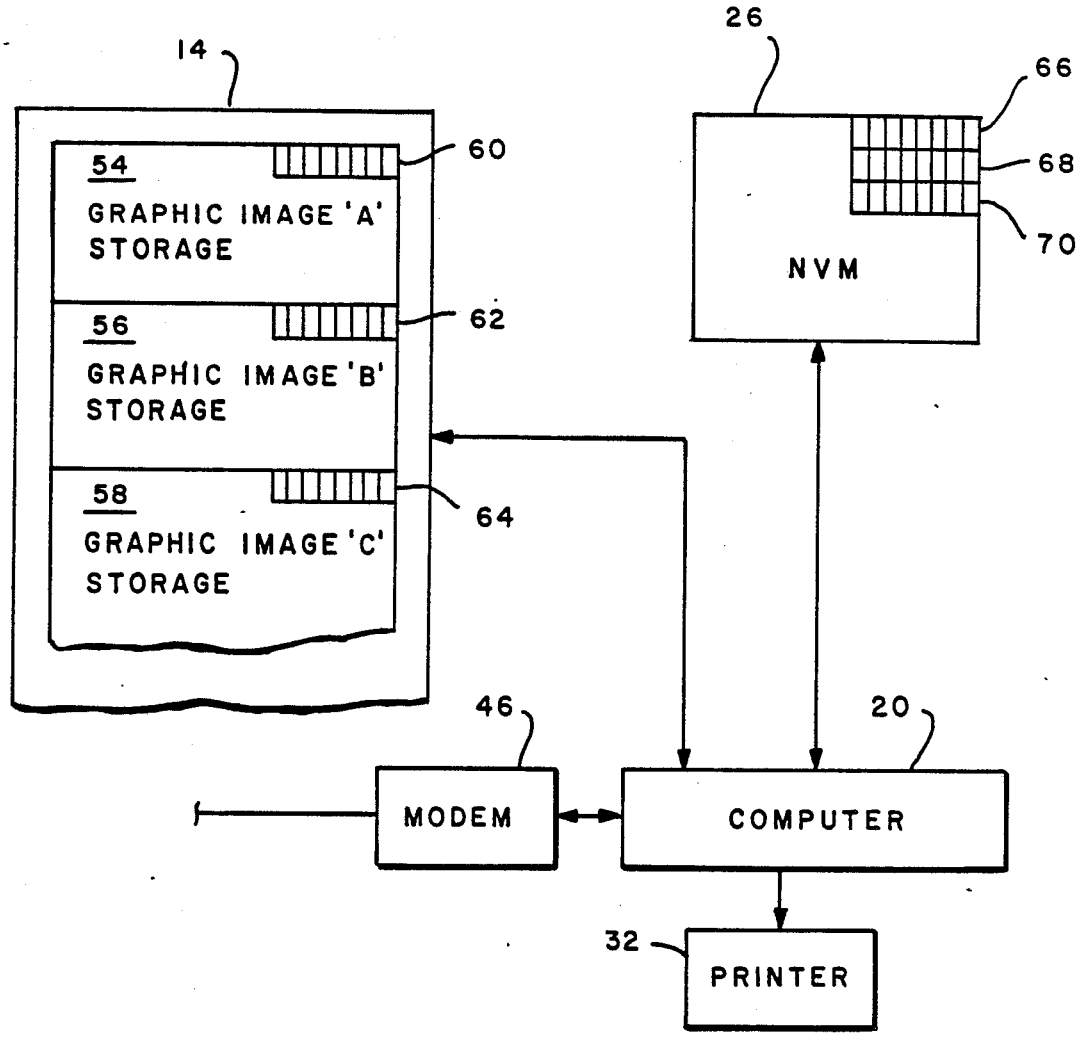
FIG. 2 is a more detailed block diagram of an indicia printing authorization means particularly useful in the system shown in FIG. 1.
Figure 3A:
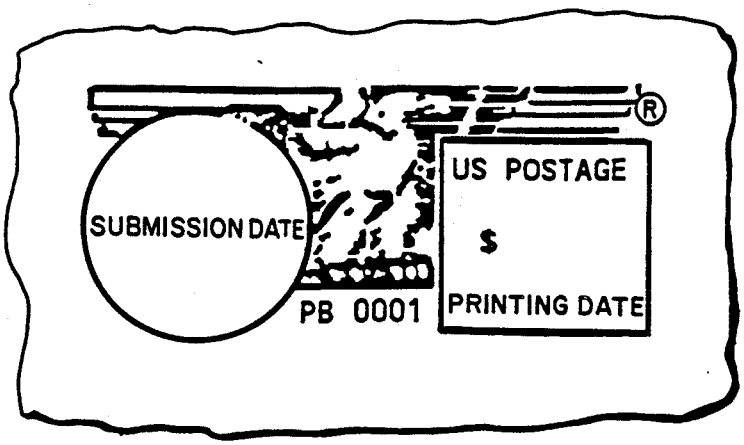
FIGS. 3A through 3C are pictorial representations, not drawn to scale, of different indicia patterns useful with the system shown FIG. 1.
Figure 3B:
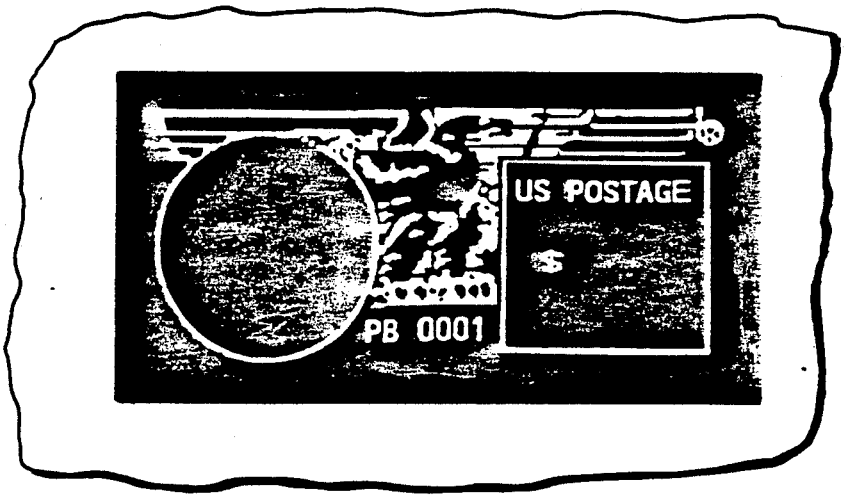
Figure 3C:
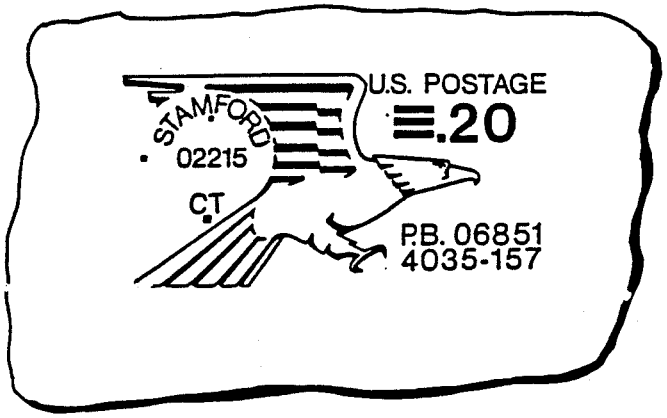

A more detailed diagram of the nonvolatile memory 26 and the means 14 for storing a plurality of indicia patterns is shown in FIG. 2. As shown therein, the means 14 includes a plurality of graphic pattern storage blocks 54, 56, and 58 for storing graphic patterns A, B, and C, respectively. In addition, in this particular embodiment, each storage block 54, 56, and 58 has a memory address 60, 62, and 64, respectively. For the purposes of this description, the graphic pattern A is depicted in FIG. 3A, the graphic pattern B is depicted in FIG. 3B, and the graphic pattern C is depicted in FIG. 3C.

Figure 4:
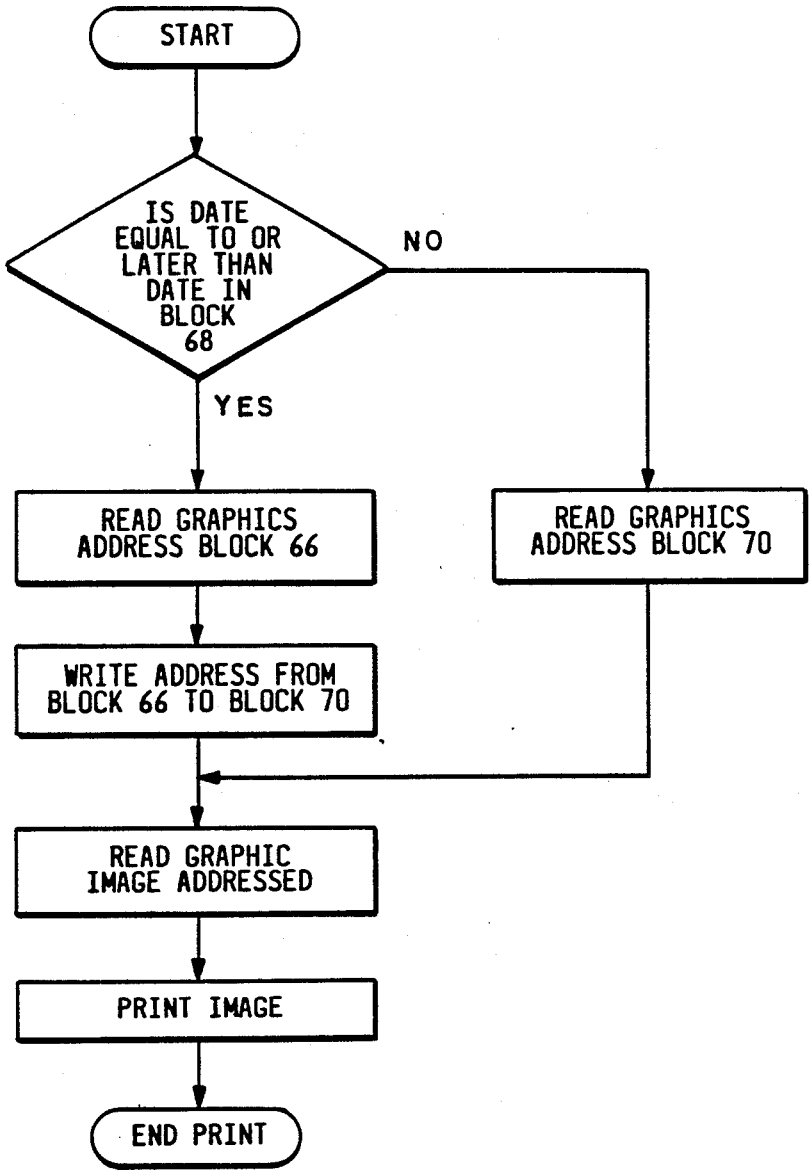
FIG. 4 is a flow diagram depicting the operation of a security system embodying the principles of the present invention.
Figure 5:
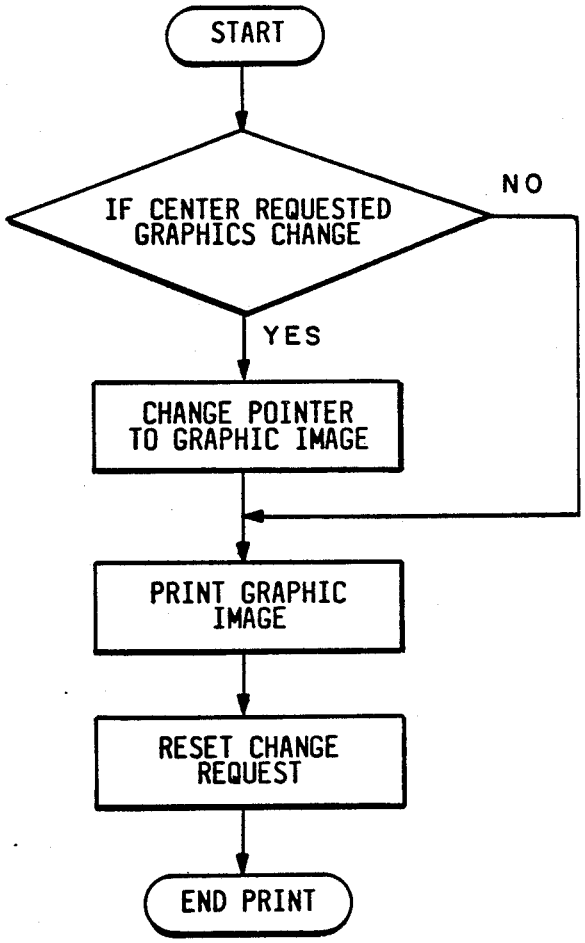
FIG. 5 is a flow diagram of another security system also embodying the principles of the present invention.

As more fully discussed with respect to FIGS. 4 and 5, the nonvolatile memory 26 includes three particularly relevant blocks of memory that are inaccessible by the user of the means 12 although numerous others will most likely exist depending on the specific application of the system 10. The first block 66 of nonvolatile memory is used, in this embodiment, to store the addresses 60, 62, or 64 of the selected graphic patterns A, B, or C, respectively. The second block 68 of nonvolatile memory is used, in this embodiment, to store the date that the use of the selected authorized indicia pattern becomes effective. The third block 70 of nonvolatile memory is used, in this embodiment, to store the addresses 60, 62, or 64 of the authorized graphic pattern prior to the date set in the second block 68.

As a preface to discussing the operation of the system 10, a brief discussion of one field wherein the system 10 has direct application is provided hereinbelow.

The particular field of application chosen for an exemplary situation wherein the present system 10 can be used is generally referred to as a manifest mail reporting system. In general, in the manifest mail reporting system a user will process a substantial plurality of mail pieces and subsequently, prior to depositing same at a post office, will produce a manifest. This manifest is sometimes also referred to as a passport, statement sheet, or the like. Upon this document the user will imprint, as a typical example, postal indicia representative of the amount of postage required to mail all of the mail pieces listed thereon. In one such system, the printing of the indicia is controlled by a user location that includes a secure accounting mechanism that is generally microprocessor controlled. This secure accounting system accounts for all funds placed into, and used by, the manifest mail reporting system. Such a system usually includes a pair of printers, one printer being rather inexpensive is used to print different types of information upon each mail piece and another printer is used to prepare the manifest or passport.

Such a system usually communicates with a central funding source that may either fund it directly or fund it through a secondary, more remote, meter refunding system. In any event, an authorized party at one of these funding centers may implement the system 10 as a means of checking the validity of the various users. In general, a decision will be made to alter the particular indicia pattern placed upon the manifest, although the change could also be made upon individual mail pieces, and a date will be selected whereupon the change is to occur. Typically, user locations having such systems are frequently large mailers and frequently communicate with such central stations for receipt of new funds. Hence, once a decision is made to change the indicia pattern, all user locations that request fund changes will be provided with the address of the new authorized indicia pattern as well as the date that it becomes authorized. Naturally, and for uniformity only, the address location for this information in the computer 20 of all of the means 12 is preferably predetermined during the installation of the device at the user location and, hence, the particular address would be common throughout this system 10. In any event, the particular address of the authorized indicia would thus be downloaded to each of the local means 12 along with the date that it is to become effective. In systems that do not communicate electronically with the means 16, the effective date can be set during a routine on-site inspection.

The operation of the system 10 can be effectively implemented via the flow diagram in FIG. 4. Therein, the means 12, for example, at some point in time subsequent to the processing of a batch of mail, is prepared to print a manifest having a postal indicia pattern thereon. The computer 20 would then make inquiry of the nonvolatile RAM 26 and compare the current date, provided by the clock/calendar 28, with the date located in memory block 68. If the date that the new postal indicia is to be authorized has not been reached, the computer 20 then reads the current graphics address block in memory block 70 and proceeds to print the current authorized indicia. However, upon determining that the date so supplied is equal to or later than the date whereupon the new indicia pattern has been authorized, the computer 20 then reads the graphics address block 66.

Preferably, at this point, the computer 20 also writes the address in address block 66 into the block 70 so that on subsequent printings the authorized indicia will always be printed. The computer 20 then accesses the particular authorized indicia graphic block and proceeds to print the indicia via the printer 32.

In this manner, only those authorized indicia printing means 12 will change the indicia pattern printed on the manifest and any authorized image printing means 12 that presents a manifest to any post office that has the erroneous indicia printed thereon will be readily detectable and suspect by the USPS.

The use of the clock/calendar 28 provides a further basic security advantage when the system 10 is used for the preparation of "future" mail. The phrase future mail derives from the practice of mailers to prepare mail at some time, usually a day or so, prior to the date that the mail will be delivered to the postal depository. Hence, if the system 10 relied on the date entered by the user at the time of processing mail, the user could easily determine the date that the indicia changed as well as obtain the indicia pattern. In the present system 10 such advanced notice is unavailable since the actual date of change of the indicia pattern is independent of any date entered by the user. For this reason, as shown in FIG. 3A, each pattern preferably includes two dates, the submission date as provided by the user and the printing date as per the clock/calendar 28. Hence, during inspection the employee responsible for checking the delivered mail would compare the printing date and indicia against the pattern that is authorized on that date.

In another embodiment, the operation of the system 10 would be substantially the same, however, to save memory space and simplify the transfer of information a change in the indicia pattern can be implemented by changing a single bit in the nonvolatile memory 26. In one such system, the changed bit would direct the computer 20 to change the format of the indicia. One preferred format change is to reverse the colors, i.e. in a black and white system this would amount to the reversal of the light and dark regions of an indicia. For example, effectively, only a single graphic pattern, for example see FIG. 3A, would need to be stored. Then, upon receipt of the single bit the printer, upon the appropriate date, would be caused to print a dot where it had not printed a dot prior to that date and vice versa. One preferred format change is to reverse the colors, i.e. in a black and white system this would amount to the reversal of the light and dark regions of an indicia. This would be readily detectable as apparent from a comparison of FIGS. 3A and 3B.

The operation of such an embodiment of the system 10 is described hereinafter with respect to the flow chart shown in FIG. 5. Upon the command to print, for example, a manifest, the computer 20 would determine whether or not a graphics change has been requested by pointing to and comparing a single bit located in the nonvolatile memory 26. If a change has been requested, then the indicia pattern so printed would be reversed; if, however, a change had not been requested, the conventional, or current, indicia pattern would then be printed. Subsequently, the computer 20 would reset the bit in the nonvolatile memory 26 in preparation for subsequent indicia pattern changes.

The present system 10 has numerous advantages, in particular, it provides a very simple mechanism for establishing the validity of a large number of mailers at a single time. This capability relieves the need for on-site inspections by the postage meter manufacturer. Another advantage is that the system 10 avoids the potential of fraud by rubber stamping and induces a "hands off" attitude among postal service users since only the postal service and the authorized personnel know precisely when the indicia pattern will be changed.

Although the present system has been generally described with respect to specific embodiments, it will be understood that other arrangements or configurations may be developed that nevertheless do not depart from the spirit and scope of the present invention. Hence, the present invention is deemed limited only by the appended claims and the reasonable interpretation thereof.

What is claimed is:

1. A security system comprising: authorization means for authorizing the printing of an indicia pattern, said authorization means including means for storing a plurality of indicia patterns;

selection means, remote from said authorization means, for selecting one of said indicia patterns to be printed by said authorization means;

control means, remote from said authorization means, for controlling said selection means for securing the selection of said one of said indicia patterns;

communication establishing means for establishing communication between aid selection means and said authorization means such that the indicia pattern printed can be used to verify the security of said authorization means; and said plurality of indicia patterns including a first graphic pattern and a second graphic pattern, and said second graphic pattern being the color reverse of said first graphic pattern.

2. System as claimed in claim 1 wherein said indicia pattern printing authorization means comprises:

a computer, said computer communicating with said selection means via said communication establishing means, said computer being connected to said indicia pattern storing means.

3. System as claimed in claim 2 further comprises:

a clock/calendar, said clock/calendar being connected said computer such that date and time information can e maintained by said computer.

4. System as claimed in claim 3 further comprises:

a nonvolatile memory in said authorization means, said nonvolatile memory being connected to said computer, said nonvolatile memory being accessible to said selection means for storing information from said selection means such that the indicia pattern selected by said selection means and stored in said authorization means can be accessed by said computer.

5. System as claimed in claim 4 wherein each of said plurality of indicia patterns has an address assigned thereto.

6. System as claimed in claim 5 wherein said nonvolatile memory includes:

a first block of memory whereat a date can be stored;

a second block of memory whereat the address of a currently selected indicia pattern can be stored; and a third block of memory whereat the address of the next selected indicia pattern can be stored.

7. System as claimed in claim 2 wherein said selection means comprises:

a second computer, said second computer communicating with said computer via said communication establishing means.

8. System as claimed in claim 7 further comprising:

means for inputting indicia pattern selection information into said second computer to control the printing of an indicia pattern stored at said authorizing means.

9. The system of claim 1 wherein the indicia patterns in said plurality of indicia patterns are stored at respective unique locations.

10. A system for detecting unauthorized mail, said system comprising:

at least one means for printing postal indicia; and means, remote from said postal indicia printing means, for controlling the selection of a particular postal indicia pattern to be used in printing a graphic pattern so that, when the particular postal indicia pattern, selected is changed only authorized mail will have the changed indicia applied thereto, resulting in the recognition of unauthorized mail.

11. System as claimed in claim 10 wherein each said means for printing a postal indicia includes:

authorization means for authorizing the printing of a postal indicia, each said authorization means including means for storing a plurality of indicia patterns; and a printer, said printer being controlled by said authorization means and capable of printing a graphic pattern using a postal indicia pattern stored by said authorization means.

12. System as claimed in claim 11 further comprising:

communication establishing means for establishing communication between each said postal indicia printing authorization means and said postal indicia selection means.

13. System as claimed in claim 12 wherein each said postal indicia printing authorization means further includes:

means for assigning an address to each stored postal indicia pattern; and a computer, said computer communicating with said selection means via said communication establishing means, said computer being connected to said indicia pattern storing means and responsive to an address provided by said selection means to provide said graphic pattern using the postal indicia pattern stored at said address.

14. System as claimed in claim 13 further comprises:

a clock/calendar, said clock/calendar being connected to said computer such that date information can be maintained; and a nonvolatile memory, said nonvolatile memory being connected to said computer, said nonvolatile memory being accessible to said selection means such that the indicia pattern selected by said selection means can be accessed by said computer, when said computer detects that the date provided by said clock/calendar is the same as a date provided by said selection means to said nonvolatile memory.

15. System as claimed in claim 14 wherein said nonvolatile memory includes:

a first block of memory whereat said date provided by said selection means can be stored;

a second block of memory whereat the address of a currently authorized indicia pattern can be stored; and a third block of memory whereat the address of the next authorized indicia pattern can be stored.

16. The system of claim 11 wherein the indicia patterns in said plurality of said indicia patterns are stored at respective unique locations.

17. System as claimed in claim 11 wherein said selection means includes:

a second computer, said second computer communicating with said computer via said communication establishing means; and means for inputting indicia pattern selection information into said second computer.

18. A method of changing an indicia pattern for verifying a plurality of indicia pattern printing means, said method comprising the steps of:

securing the selection of an indicia pattern from a plurality of indicia patterns;

selecting a particular indicia pattern and an effective data therefore from a plurality of indicia patterns;

communicating the selection of said particular indicia pattern and said effective date to each of said plurality of indicia pattern printing means; and authorizing said printing means to print said particular pattern as of said effective date.

19. The method as claimed in claim 18 wherein said communicating step includes the step of:

storing said selection and said effective date therefor in a secure memory in each of said indicia pattern printing means.

20. The method as claimed in claim 19 further comprising the step of:

inputting said selection and said effective date therefor into said secure memory via a computer at each of said plurality of indicia pattern printing means.

21. The method as claimed in claim 20 further comprising the step of:

storing, at each of said plurality of indicia printing means, a plurality of indicia patterns.

22. The method of claim 18 wherein the indicia patterns in said plurality of indicia patterns are stored at respective unique locations at the printing means.

23. The method as claimed in claim 20 further comprising the step of:

storing, at each of said plurality of indicia printing means, a plurality of postal indicia patterns.

* * * * *